United States Patent [19]

Fenne

[11] 4,244,342

[45] Jan. 13, 1981

[54] FUEL INJECTION SYSTEM

[75] Inventor: Ivor Fenne, Greenford, England

[73] Assignee: Lucas Industries Limited, Birmingham, England

[21] Appl. No.: 958,542

[22] Filed: Nov. 8, 1978

[30] Foreign Application Priority Data

Dec. 9, 1977 [GB] United Kingdom ..... 51266/77

[51] Int. Cl.[3] ..... F02M 49/02; F02M 51/00

[52] U.S. Cl. ..... 123/501; 123/446; 239/87; 239/585

[58] Field of Search ..... 123/139 AJ, 139 AK, 123/139 R, 139 AF, 139 E; 239/87, 585

[56] References Cited

U.S. PATENT DOCUMENTS

| | | | |
|---|---|---|---|
| 3,055,593 | 9/1962 | May | 239/87 |
| 3,680,782 | 8/1972 | Monpetit | 239/585 |
| 3,782,352 | 1/1974 | Sparber | 123/139 AJ |
| 3,796,206 | 3/1974 | Links | 123/139 E |
| 3,870,025 | 3/1975 | Anderson | 123/139 AF |
| 3,919,989 | 11/1975 | Jarrett | 123/139 R |
| 4,046,112 | 9/1977 | Deckard | 123/139 E |
| 4,129,253 | 12/1978 | Bader | 123/139 E |
| 4,129,254 | 12/1978 | Bader | 123/139 E |

FOREIGN PATENT DOCUMENTS

| | | | |
|---|---|---|---|
| 2012202 | 10/1971 | Fed. Rep. of Germany | 239/585 |
| 2609358 | 9/1976 | Fed. Rep. of Germany | 239/87 |

*Primary Examiner*—Ronald H. Lazarus
*Assistant Examiner*—Carl Stuart Miller

[57] ABSTRACT

A fuel injection system for supplying fuel to an internal combustion engine includes a piston slidable within a cylinder, the piston being subjected to the pressure of air within the engine cylinder during the compression stroke. Displacement of the piston generates a fuel pressure in a pumping chamber which is sufficiently high to open the valve member of a fuel injection nozzle which fuel is supplied to the combustion space. A valve is provided through which fuel can be admitted to the cylinder from a source of fuel under pressure and a non-return valve is provided between the aforesaid cylinder and the pumping chamber.

15 Claims, 1 Drawing Figure

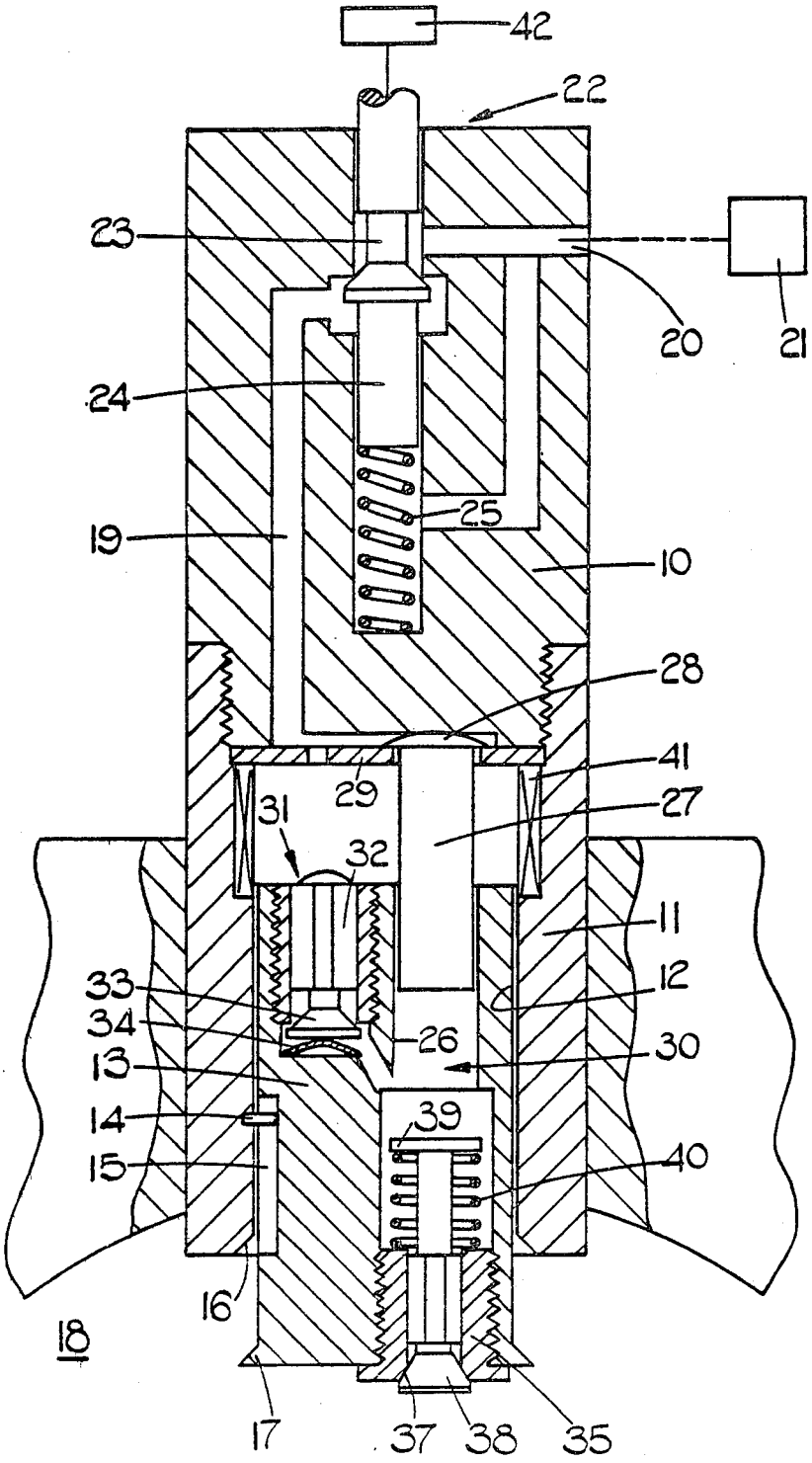
42
22
23
20
21
24
25
19
10
28
41
29
27
31
32
11
33
12
34
26
30
13
39
14
40
15
16
18
17
37
38
35

FUEL INJECTION SYSTEM

This invention relates to a fuel injection system for supplying fuel to a combustion space of an internal combustion engine and is of the kind including a piston slidable within a cylinder, the piston in use, being subjected to the pressure of air within the engine cylinder during the compression stroke, to effect movement of the piston for the purpose of generating a fuel pressure which is sufficiently high to open the valve member of a fuel injection nozzle and through which fuel is supplied to the combustion space.

The object of the invention is to provide a fuel injection system of the kind specified in a simple and convenient form.

According to the invention a fuel injection system of the kind specified comprises a further cylinder, a plunger slidable within said further cylinder, said further cylinder and said plunger defining a pumping chamber communicating with said nozzle and from which fuel flows when the piston is moved by the air pressure within the combustion space, valve means operable to admit fuel under pressure to the closed end of said first mentioned cylinder from a source of fuel under pressure and a non-return valve through which the closed end of the first mentioned cylinder is in communication with said pumping chamber, the arrangement being such that during movement of the piston to effect a reduction in the volume of the pumping chamber, said non-return valve is closed so that the fuel displaced from the pumping chamber flows to said nozzle, and when fuel is supplied to said cylinder to effect displacement of the piston to increase the size of the pumping chamber, fuel can flow to the pumping chamber by way of said non-return valve.

One example of a fuel injection system in accordance with the invention will now be described with reference to the accompanying diagrammatic drawing.

The apparatus comprises a body part 10 to one end of which is secured a sleeve 11 the internal peripheral surface of which constitutes a cylinder 12. Slidable within the cylinder 2 is a piston 13 which is restrained against angular movement and is allowed limited axial movement by means of a pin 14 carried by the sleeve and slidable within a slot 15 formed in the piston. The end of the sleeve 11 remote from the body 10 defines a seating 16 which is engageable by a complementarily shaped peripheral flange 17 formed on the piston.

In use, the body portion 10 and the sleeve 11 are positioned within a bore formed in a cylinder head of an engine and the end of the sleeve 11 projects into a combustion space 18 of the engine. It will be appreciated that each combustion space is provided with the unit so far described.

Formed within the body part 10 is a fuel passage 19 which communicates with the closed end of the cylinder 12. The passage 19 communicates with a fuel inlet 20 which in use is connected to a source 21 of liquid fuel under pressure. Moreover, positioned in the passage 19 is a valve means generally indicated at 22 and which includes a valve member 23 connected to a head engageable with a seating to prevent flow of fuel from the source to the chamber. Conveniently the valve member is pressure balanced by means of a balancing plunger 24 which is subjected to the pressure at the inlet 20. Furthermore, a coiled compression spring 25 is provided to lightly bias the valve member 23 to the closed position.

Formed within the piston 13 is a further cylinder 26 in which is located a plunger 27. The plunger 27 has a head 28 which conveniently is retained against axial movement, beneath an apertured plate 29 held against the closed end of the cylinder 12. The plunger 27 and the cylinder 26 constitute a pumping chamber 30.

The pumping chamber 30 is in communication with the closed end of the cylinder 12 by way of a non-return valve which is generally indicated at 31. The valve comprises a screw threaded sleeve located in a bore in the piston, and a valve member 32 which has a fluted body slidable within the sleeve and a head 33 engageable with a seating defined by the edge of the sleeve. A leaf spring 34 is provided to lightly bias the head of the valve member onto the seating.

The chamber 30 also is in communication with a fuel injection nozzle which is generally indicated at 35. This comprises a sleeve screw threaded into a bore forming an extension of the cylinder 26, the sleeve defining a seating 37 with which can co-operate the head 38 of a valve member. The stem of the valve member is fluted and is guided by the internal peripheral surface of the sleeve and the stem is also provided with a head 39 between which and the sleeve, is located a coiled compression spring, 40.

The operation of the apparatus will now be described starting with the parts in the position shown in the drawing. As shown the valve 22 is closed and it is assumed that the compression stroke of the piston with which the combustion space 18 is associated, is just starting. The air pressure within the combustion space 18 will increase but no movement of the parts will take place other than a slight movement of the piston 13 under the action of the air pressure, to cause the fuel contained within the various cylinders and chambers to be slightly compressed. At some chosen point the valve means 22 is opened and when this occurs the pressure in the closed end of the cylinder 12 reduces to that of the source 21. As a result the piston 13 can now move towards the closed end of the cylinder and in so doing the fuel pressure within the pumping chamber 30 increases to the point at which the head 38 of the nozzle 35 is lifted from its seating. Fuel is therefore delivered to the combustion space through the nozzle. The inward movement of the piston continues until the flange 17 engages the seating. When this occurs the wall of the cylinder 12 and also the wall of the piston, are protected from the corrosive effect of the combustion gases within the combustion space. Moreover, it is arranged that just prior to the flange contacting the seating, the valve head 33 of the non-return valve 31 is lifted from its seating. This is effected by the abutment of a projection on the stem of the valve member with the plate 29. This feature results in a rapid reduction in the pressure of fuel within the pumping chamber 30 and thereby rapid closure of the head 38 onto the seating 37.

During the induction stroke of the engine piston, fuel under pressure from the source 21 flows into the closed end of the cylinder 12. This has the effect of causing outward movement of the piston 13 and as a result of such movement the volume of the pumping chamber 30 increases. The head 33 of the valve member is lifted from its seating by the pressure difference, against the action of the spring 34, and fuel flows into the pumping chamber. When a sufficient quantity of fuel has flowed into the pumping chamber, the valve means 22 is closed and the parts remain in the position they have assumed, ready for the next injection stroke.

The quantity of fuel which is delivered at each injection stroke, can be determined in a number of ways. It is possible to use the valve means 22 as a throttle valve. In this case the amount of fuel which flows past the valve will be determined by the pressure of fuel delivered by the source and the time the valve is open. Alternatively, the valve can be opened fully for a much shorter time. A positive control of the amount of fuel supplied to the pumping chamber can be obtained by sensing the movement of the piston 13 when the valve means 22 is opened. This can be achieved by means of a transducer which in the example is in the form of a sensing coil 41 which is positioned in the closed end of the cylinder 12. The sensing coil will provide a signal to control means which in turn controls the operation of the valve means 22. Conveniently the valve means 22 is operated by means of a solenoid 42. The valve may however, be actuated by an engine driven cam and an adjustable stop provided to limit the extent of outward movement of the piston 13. In this manner the system is completely mechanical.

In the above described arrangement the termination of injection of fuel is achieved using the non-return valve 31 which is opened just before the flange 17 closes onto the seating. It is possible to simplify the construction of the non-return valve 31 so as to be able to employ a simple spring loaded ball valve, if passages and co-operating ports are machined in the plunger 27 and the cylinder 26, these passages and ports placing the pumping chamber 30 in communication with the closed end of the cylinder 12 just before the flange engages the seating.

It is also possible to provide for pilot injection of fuel. This can be achieved if the volume of fuel in the closed end of the cylinder 12 is made deliberately large so that during the initial movement of the piston 13 to compress the fuel, a small quantity of fuel will be displaced from the pumping chamber 30. Alternatively it is possible to arrange that the valve means 22 is opened and closed quickly to achieve pilot injection followed by reopening of the valve means for the main injection of fuel.

It will be appreciated that when the valve means 22 is controlled by a solenoid, the associated control circuit must also receive an engine timing signal to ensure that injection of fuel occurs at the correct time. Such a system has flexible timing and in conjunction with the sensing coil 41, precise control of the amount of fuel which is injected into the combustion chamber. The system also provides spillage of fuel at the end of the injection period in order to achieve rapid closure of the valve member of the injection nozzle. In addition pilot injection of fuel can also be obtained and the system has the further advantage that only one low pressure fuel pump is required for connection to the system.

I claim:

1. A fuel injection system for supplying fuel to a combustion space of an internal combustion engine and including a piston slidable within a cylinder, the piston in use being subjected to the pressure of air within the engine cylinder during the compression stroke to effect movement of the piston for the purpose of generating a fuel pressure which is sufficiently high to open the valve member of a fuel injection nozzle and through which fuel is supplied to the combustion space, a further cylinder, a plunger slidable within said further cylinder, said further cylinder and said plunger defining a pumping chamber communicating with said nozzle and from which fuel flows when the piston is moved by the air pressure within the combustion space, valve means operable to admit fuel under pressure to the closed end of said first mentioned cylinder from a source of fuel under pressure, and a non-return valve through which the closed end of the first mentioned cylinder is in communication with said pumping chamber, said non-return valve being carried by said piston and includes a valve member which is biased into contact with a seating by resilient means and during delivery of fuel to the associated engine by the predominent fuel pressure in said further cylinder, said valve member towards the end of the inward stroke of said piston being lifted from said seating to cause a reduction in the pressure in said further cylinder thereby to allow rapid closure of the fuel injection nozzle, the arrangement being such that during movement of the piston to effect a reduction in the volume of the pumping chamber, said non-return valve is closed so that the fuel displaced from the pumping chamber flows to said nozzle, and when fuel is supplied to said cylinder to effect displacement of the piston to increase the size of the pumping chamber, fuel can flow to the pumping chamber by way of said non-return valve.

2. A system according to claim 1 in which said non-return valve includes a sleeve which is secured within a recess in the inner face of said piston, the end of the valve member extending beyond said inner face for engagement with an abutment member towards the end of the inward movement of said piston.

3. A fuel injection system for supplying fuel to a combustion space of an internal combustion engine and including a piston slidable within a cylinder, the piston in use being subjected to the pressure of air within the engine cylinder during the compression stroke to effect movement of the piston for the purpose of generating a fuel pressure which is sufficiently high to open the valve member of a fuel injection nozzle and through which fuel is supplied to the combustion space, a further cylinder defined in said piston, a plunger slidable within said further cylinder extending from the inner face of said piston and having a head at its end projecting from the piston, engaged with an abutment plate secured within said cylinder, said further cylinder and said plunger defining a pumping chamber communicating with said nozzle and from which fuel flows when the piston is moved by the air pressure within the combustion space, valve means operated by solenoid means the flow of current in which is determined by a control system which receives a signal indicative of the position of the rotating parts of the associated engine, said valve means being operable to admit fuel under pressure to the closed end of said first mentioned cylinder from a source of fuel under pressure and being retained in the closed position until delivery of fuel is required during a compression stroke of the engine piston of the associated engine cylinder, and a non-return valve through which the closed end of the first mentioned cylinder is in communication with said pumping chamber, the arrangement being such that during movement of the piston to effect a reduction in the volume of the pumping chamber, said non-return valve is closed so that the fuel displaced from the pumping chamber flows to said nozzle, and when fuel is supplied to said cylinder to effect displacement of the piston to increase the size of the pumping chamber, fuel can flow to the pumping chamber by way of said non-return valve.

4. A system according to claim 3 in which during a suction stroke of the engine piston said valve means is retained in the open position until the desired quantity of fuel has entered the further cylinder.

5. A system according to claim 3 in which the volume of said cylinder is sufficiently high so that an initial movement of the piston within the cylinder occurs which is sufficient to cause a pilot quantity of fuel to be delivered from said further cylinder through the injection nozzle to the associated engine cylinder.

6. A system according to claim 3 in which said valve means is initially opened and closed to allow a pilot quantity of fuel to be delivered through the injection nozzle to the associated engine cylinder, the valve means re-opened when the main flow of fuel is required.

7. A fuel injection system for supplying fuel to a combustion space of an internal combustion engine and including a piston slidable within a cylinder, said cylinder having a closed end the piston in use, being subjected to the pressure of air within the engine cylinder during the compression stroke, to effect movement of the piston for the purpose of generating a fuel pressure which is sufficiently high to open a valve member of a fuel injection nozzle through which fuel is supplied to the combustion space, a further cylinder, a plunger slidable within said further cylinder, said further cylinder and said plunger defining a pumping chamber communicating with said nozzle and from which fuel flows when the piston is moved by the air pressure within the combustion space, valve means operable to control the flow of fuel to and from the closed end of said first mentioned cylinder from a source of fuel under pressure and a non-return valve through which the closed end of the first mentioned cylinder is in communication with said pumping chamber, the arrangement being such that during movement of the piston to effect a reduction in the volume of the pumping chamber, said non-return valve is closed so that the fuel displaced from the pumping chamber flows to said nozzle, and when fuel is supplied to said cylinder to effect displacement of the piston to increase the size of the pumping chamber, fuel can flow to the pumping chamber by way of said non-return valve.

8. A system according to claim 7 in which the fuel injection nozzle is mounted on said piston.

9. A system according to claim 8 in which the fuel injection nozzle includes a sleeve which defines a seating for a valve member forming part of the nozzle, said sleeve being secured within a bore which is formed as an extension of said further cylinder.

10. A system according to claim 9 in which the valve member is slidable within a bore defined by the sleeve, the seating being defined at the outer end of said bore, the valve member including a head for co-operation with said seating and resilient means being provided to bias the head into contact with the seating.

11. A system according to claim 7 in which said further cylinder is defined in said piston, said plunger extending from the inner face of said piston, said plunger having a head at its end projecting from the piston, said head being engaged with an abutment plate secured within said cylinder.

12. A system according to claim 1 in which said valve means is operated by solenoid means the flow of current in which is determined by a control system which receives a signal indicative of the position of the rotating parts of the associated engine.

13. A system according to claim 4 in which a signal indicative of the quantity of fuel in said further cylinder is provided by a transducer responsive to the position of the piston.

14. A system according to claim 11 in which said valve means is operated by a cam driven by the associated engine.

15. A system according to claim 14 including means for limiting the movement of the piston under the action of fuel under pressure delivered to the cylinder.

* * * * *